US009163476B2

(12) United States Patent
Hathcoat et al.

(10) Patent No.: US 9,163,476 B2
(45) Date of Patent: Oct. 20, 2015

(54) SELECTIVE SET MODULE FOR MULTI STRING PACKERS

(75) Inventors: Joe Butler Hathcoat, Conroe, TX (US); Tri Thien Nguyen, Huntsville, TX (US); Anthony Charles Machala, New Waverly, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 567 days.

(21) Appl. No.: 13/313,603

(22) Filed: Dec. 7, 2011

(65) Prior Publication Data

US 2013/0146311 A1 Jun. 13, 2013

(51) Int. Cl.
*E21B 33/122* (2006.01)

(52) U.S. Cl.
CPC ..... *E21B 33/122* (2013.01)

(58) Field of Classification Search
USPC ..... 166/387, 189
See application file for complete search history.

(56) References Cited

U.S. PATENT DOCUMENTS

| | | | | |
|---|---|---|---|---|
| 2,975,836 A | | 3/1961 | Brown | |
| 3,252,516 A | * | 5/1966 | Leutwyler | 166/120 |
| 3,381,752 A | * | 5/1968 | Elliston | 166/120 |
| 3,841,400 A | * | 10/1974 | Callihan et al. | 166/120 |
| 4,505,332 A | * | 3/1985 | Mills et al. | 166/120 |
| 4,754,812 A | * | 7/1988 | Gentry | 166/313 |
| 5,425,418 A | * | 6/1995 | Arizmendi et al. | 166/120 |
| 5,505,258 A | | 4/1996 | Muth | |
| 6,315,054 B1 | | 11/2001 | Brunet | |
| 6,609,567 B2 | * | 8/2003 | Ingram et al. | 166/126 |

FOREIGN PATENT DOCUMENTS

| | | | |
|---|---|---|---|
| RU | 4777 | U1 | 8/1997 |
| RU | 2182958 | C2 | 5/2002 |
| RU | 2213842 | C2 | 10/2003 |
| RU | 2344274 | C1 | 1/2009 |
| RU | 2425955 | C1 | 8/2011 |

OTHER PUBLICATIONS

Examination Report received in Australian application No. 2012258499, received Mar. 3, 2014.

* cited by examiner

*Primary Examiner* — Robert E Fuller
(74) *Attorney, Agent, or Firm* — Wong, Cabello, Lutsch, Rutherford & Brucculeri LLP

(57) ABSTRACT

A dual string packer may be provided with a crossover module located such that fluid communication may be provided from any tubular bore to the internal shifting chamber without completely disassembling the dual string packer. The crossover module may be attached to the through tubing mandrels at or near the bottom or lower end of the dual string packer.

15 Claims, 6 Drawing Sheets

SELECTIVE SET MODULE FOR MULTI STRING PACKERS

BACKGROUND

In the course of producing oil and gas wells typically a well packer along with completion and production equipment are run into cased wellbore. Upon reaching a predetermined depth the packer is set to the casing. A well packer may accommodate several tubular strings passing through the packer although two production tubular strings passing through a single packer is the most common due to wellbore diameter restrictions.

In many instances it may be desirable to be able to produce many different formation zones independently such as in multi-lateral wellbores or when the various formation zones have differing mechanical or chemical properties. In some instances each zone may require a separate production tubular or a separate control line. When multiple control lines or production tubulars are required to pass through a packer an at least dual zone packer may be required.

The purpose of a dual zone packer is to seal the wellbore against fluid or gas flow at the location of the packer while allowing the production tubulars or control lines to pass through. The packer is provided with slips having camming surfaces which, when activated, cooperate with complimentary opposed wedging surfaces to radially extend to and grip the wellbore casing. The packer also has an annular resilient seal, usually an elastomer, that is typically radially expanded to seal against the casing. Both the resilient seal and the camming surfaces that extend the slips are usually activated by a longitudinal compression of the packer. The longitudinal compression may be effected by mechanical or hydraulic means. When a dual zone packer is run into the wellbore it is usually retained in the unset position, typically by a shear pin or a c-ring.

Conventional dual string packers incorporate at least a pair of tubular mandrels on which a packing seal element and slip assembly are mounted. Typically the dual bore packer is prepared for setting by closing one of the mandrels to fluid flow. The fluid flow may be closed by using a ball, plug, dart, or any other device that may form a seal to block the particular tubular.

The resilient packer and the slip assembly are typically radially extended by a hydraulic piston that applies longitudinal compressive force in response to hydraulic pressure in the blocked mandrel. Setting forces are applied to the annular seal elements and the anchor by a setting cylinder mounted to the packer mandrel.

In certain instances it may be necessary to release the dual string packer in order to remove it from the wellbore. In order to facilitate easy removal of the packer from the wellbore certain features must be incorporated into the dual string packer as it is constructed. Typically the packer is constructed so that tension may be applied from the surface through one of the tubular mandrels to a shear assembly in the body of the packer. The tubular mandrel used to release the tension in the tool is typically referred to as the long side of the dual string packer. When enough tension is applied to the shear assembly from the surface to overcome the shear assembly's internal resistance and shears the relevant portions of the assembly the longitudinal compression applied to radially extend the slips and the resilient seal is released. The slips and the resilient seal no longer lock and seal the dual string packer to the casing and the dual string packer may be removed to the surface.

It is sometimes necessary to use one particular bore and at other times it is necessary to use the other bore as the source of hydraulic pressure to set the slips and the resilient seal. However, because only the long side of the dual string packer can be used to remove the dual string packer from the well and because each mandrel bore may have different requirements due to equipment and other requirements of the well, the operator is not usually able to easily reverse the orientation of the dual string packer prior to its deployment. It is usually necessary to reconfigure the internal portions of the dual string packer.

Typically, one of the tubing mandrels has a port built into it so that a flow path is created by the particular mandrel and the internal shifting chamber, while the other tubing mandrel has the necessary shear pins and other components to release the slips and seals when necessary. Since the through tubing mandrels pass through and are attached to the internal components of the dual string packer, a complete top to bottom rebuild of the dual string packer, usually on the rig floor, is called for in order to reconfigure the internal portions of the dual string packer. Such a rebuild takes valuable rig time and leads to possible contamination and potential failure of the tool when the dual string packer is deployed downhole.

SUMMARY

In order to overcome the need to completely disassemble a dual or even possibly a multiple string packer on the rig floor and to avoid the delays and potential for failure that such a rebuild entails, a crossover module may be attached to the through tubing mandrels at or near the bottom or lower end of the dual string packer.

By attaching the crossover module near the bottom of the dual string packer through tubing, the dual string packer may be plumbed so that any of the through tubing mandrels may supply the pressure to the shifting chamber that is required in order to set the slips or the seal.

The crossover module typically has a series of through bores that match the bores of the shifting chamber and any of the through tubing mandrels. Additionally, the crossover module has a port that connects at least one of the through tubing mandrels to the usually centrally located shifting chamber. Depending upon the size and orientation of the various through tubing mandrels, the crossover module may have a mirror image from one side of the cassette to the other and may be rotated about an axis orthogonal to the longitudinal axis to allow various through tubing mandrels to provide pressure to the shifting chamber. In other configurations it may be possible to easily loosen the crossover module and rotate the crossover module about its longitudinal axis to the position desired to allow various through tubing mandrels to provide pressure to the shifting chamber.

A typical dual string packer with a crossover module has a housing having at least two longitudinal flow passages, a top end, a bottom end, a seal movably mounted on the housing, a slip assembly supported on the housing, a bore in the housing, and a crossover module allowing fluid communication between the bore in the housing and a longitudinal flow passage. In some instances the crossover module is located towards the bottom end of the housing. The bore in the housing usually defines a pressure chamber and the pressure chamber usually is a setting assembly. The setting assembly or pressure chamber applies force to set the slip assembly that in turn sets the seal, if necessary, and sets the slips. Sometimes the seal may be made of a swellable elastomer. Therefore, no setting force is necessary, but may be applied. The crossover module may rotate about a longitudinal axis or about an axis orthogonal to the longitudinal axis to provide fluid communication between the bore in the housing and a longitudinal flow passage.

In an alternative embodiment the dual or multiple string packer may have a tubular body mandrel with at least two longitudinal flow passages, a top end, a bottom end, a seal mounted on the tubular body mandrel, a slip assembly supported on the tubular body mandrel, a setting chamber in the tubular body mandrel, and a movable crossover module allowing fluid communication between at least one of the longitudinal flow passages and a setting chamber. The setting chamber applies force to set the slip assembly and if needed to the seal. In some instances the seal may be a swellable seal. The movable crossover module may rotate about a longitudinal axis or about an axis orthogonal to the longitudinal axis to provide fluid communication between the setting chamber and a longitudinal flow passage.

A method of assembling a multiple string packer provides for a housing having a top end, a bottom end, at least two longitudinal flow passages, and a usually centrally located bore. A seal and a slip assembly are also mounted on the housing. At some point, a crossover module, usually located towards the bottom end of the housing, may be oriented so that fluid may flow between the bore in the housing and a longitudinal flow passage. In some instances the bore in the housing may be used as a pressure chamber and incorporate a setting assembly. The pressure chamber applies force to set the slip assembly and the seal. In some instances the seal may be a swellable elastomer and setting force may or may not be used. The crossover module rotates about a longitudinal axis or about an axis orthogonal to the longitudinal axis to provide fluid communication between the bore in the housing and a longitudinal flow passage.

DETAILED DESCRIPTION

The description that follows includes exemplary apparatuses, methods, techniques, and instruction sequences that embody techniques of the inventive subject matter. However, it is understood that the described embodiments may be practiced without these specific details.

Figure 1:
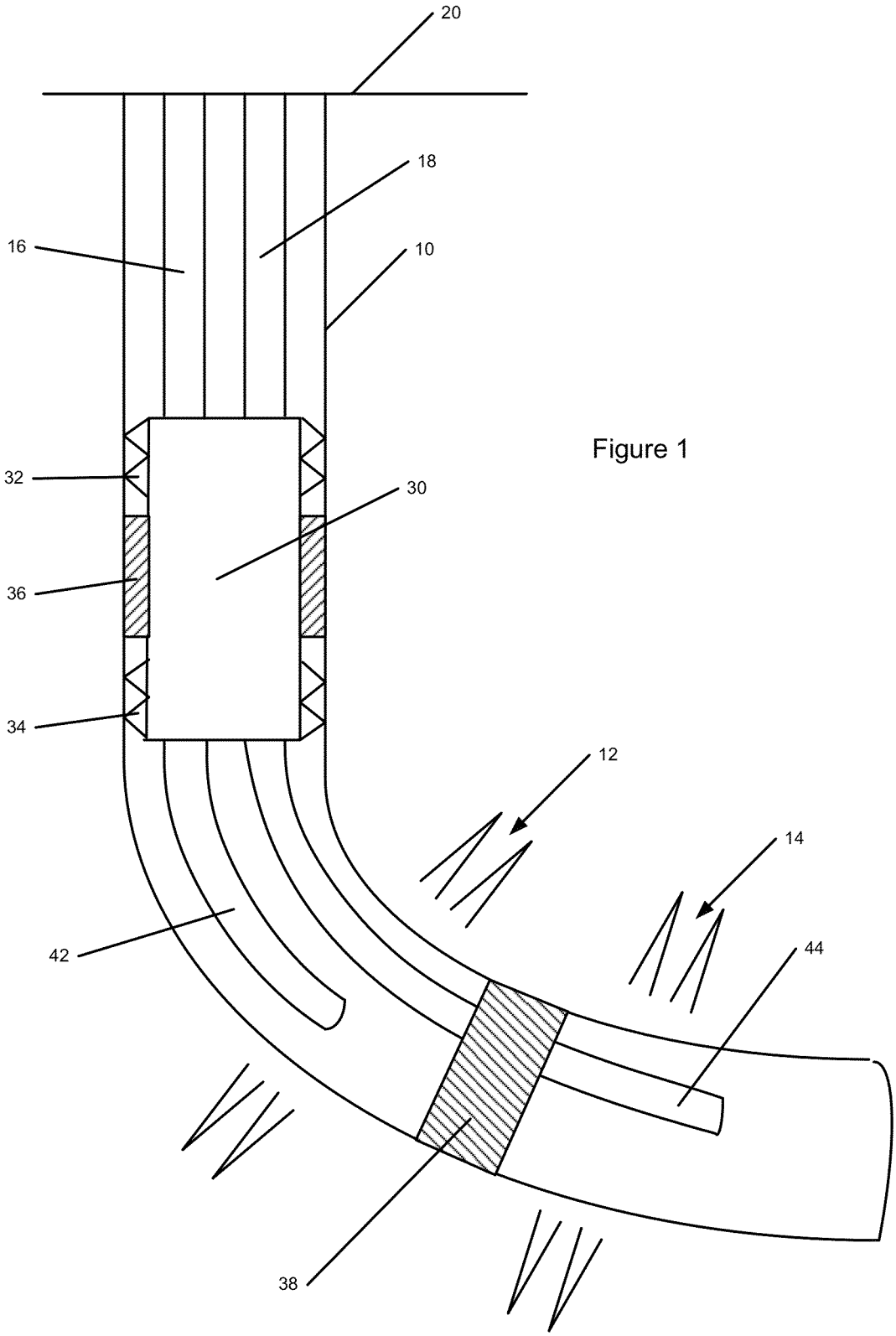
FIG. 1 depicts a schematic view of a wellbore with at least two formation zones.

FIG. 1 depicts a schematic view of a wellbore 10 with at least two formation zones, formation zone 12 and formation zone 14. The downhole assembly typically consists of at least two upper tubular strings, tubular string 16 and tubular string 18 each extending from the surface 20 to the at least dual string packer 30 with upper slip 32, lower slip 34, and seal 36. Also shown is a packer 38 isolating formation zone 12 and formation zone 14 from one another. The downhole assembly also has at least two lower tubular strings, tubular string 42 and tubular string 44, each extending from the at least dual string packer 30 to an isolated portion of the wellbore 10 each corresponding to a particular formation zone such as formation zone 12 and formation zone 14.

Typically tubular string 16 and tubular string 42 are fluidly connected through the at least dual string packer 30. Also, typically tubular string 18 and tubular string 44 are fluidly connected through the at least dual string packer 30. By isolating the wellbore 10 into at least two formation zones 12 and formation zone 14 while fluidly connecting each formation zones 12 and formation zone 14 to the surface 20 the operator may complete, produce, or otherwise treat each formation zones 12 and formation zone 14 independently of each other.

Figure 2:
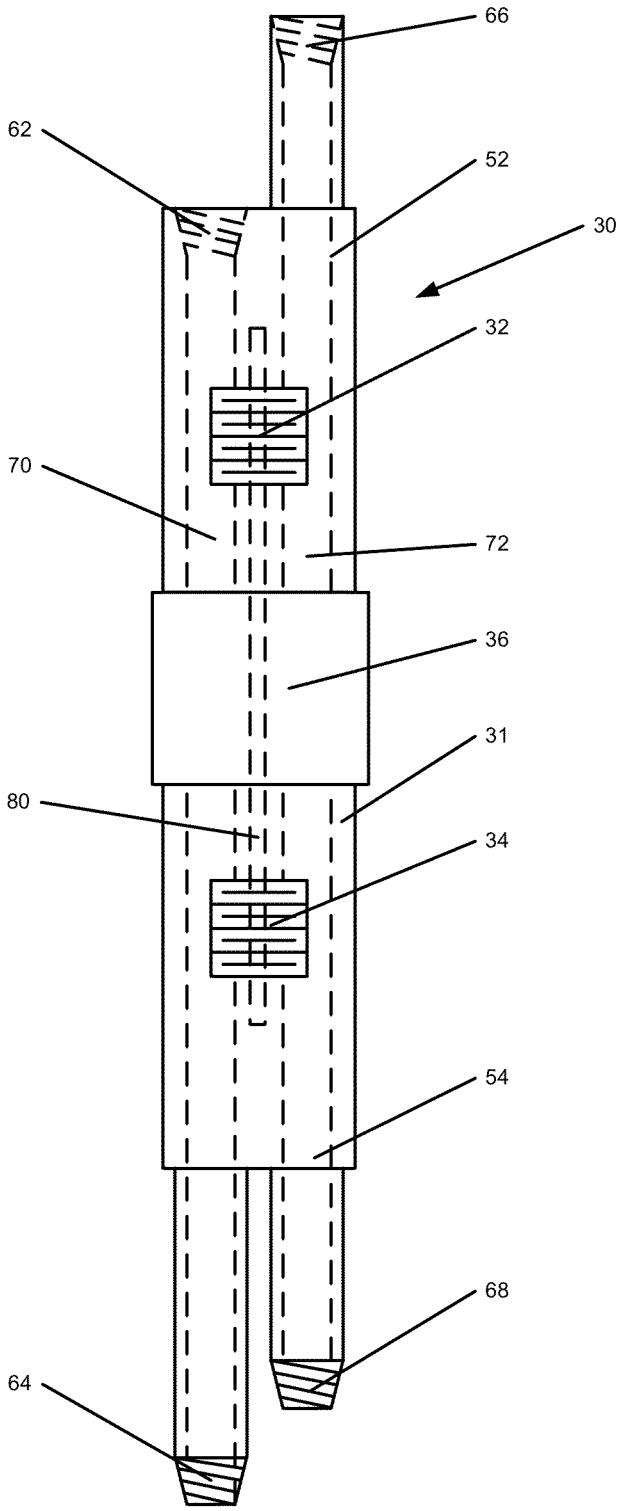
FIG. 2 depicts a dual string packer.

FIG. 2 depicts a more detailed view of the typical at least dual string packer 30. For ease of reference the top of the figures are designated as up or towards the surface 20 (FIG. 1). The typical dual string packer 30 depicts a packer housing 31, having at least two longitudinal flow passages shown as tubular bore 70 and tubular bore 72. The typical dual string packer 30 also depicts a dual string packer upper end 52, a dual string packer lower end 54, a resilient elastomeric seal 36, an upper slip 32, a lower slip 34, an upper end 62 of tubular bore 70, a lower end 64 of tubular bore 70, an upper end 66 of tubular bore 72, a lower end 68 of tubular bore 72, and a bore or internal setting chamber 80 in the housing.

Typically the dual string packer 30 is run into the wellbore 10 until the tubular strings 42 and 44 are properly placed and formation zones 12 and 14 are isolated from one another by setting at least packer 38. A ball, dart, or other movable plug is deposited in the well to seal against a seat in tubular bore 72 but below the location of a port (not shown) in the dual string packer 30 allowing fluid communication between a tubular and the setting chamber 80. Pressure is then applied from the surface 20 to pressurize the setting chamber 80 and thus supply the necessary mechanical force to compress and thus radially extend the slips 32 and 34 and the resilient elastomeric seal 36 thereby locking the dual string packer into position in wellbore 10 and sealing the dual string packer 30 to the sides of the wellbore 10 forming zones above and below the dual string packer that are isolated from one another with the exception of any tubulars such as tubular string 42 and 44 that pass through the dual string packer 30.

In a dual string packer 30, one of the tubular bores such as tubular bore 72 is designated as the long side. By being designated as the long side, the components required to release the slips 32 and 34 and seals 36 are linked to that particular side, while another tubular bore such as tubular bore 70 is fluidly connected to the internal setting chamber 80. In certain instances it may be necessary to change the internal fluid connection between one tubular and another. In these instances due to the linkages between the long side tubular bore 72 and the components necessary to release the slips 32 and 34 and the seal 36 as well as the internal fluid connection between tubular bore 70 and the internal setting chamber 80 it is necessary to completely disassemble the dual string packer 30 in order to change the internal fluid connection from one tubular and another. Such disassembly usually takes place on the rig floor and may lead to delay as well as an increased possibility of the dual string packer failing when deployed.

In order to reduce the rig down time and the chance of failure due to contamination of the dual string packer while disassembled on the rig floor a crossover module may be used.

Figure 4:
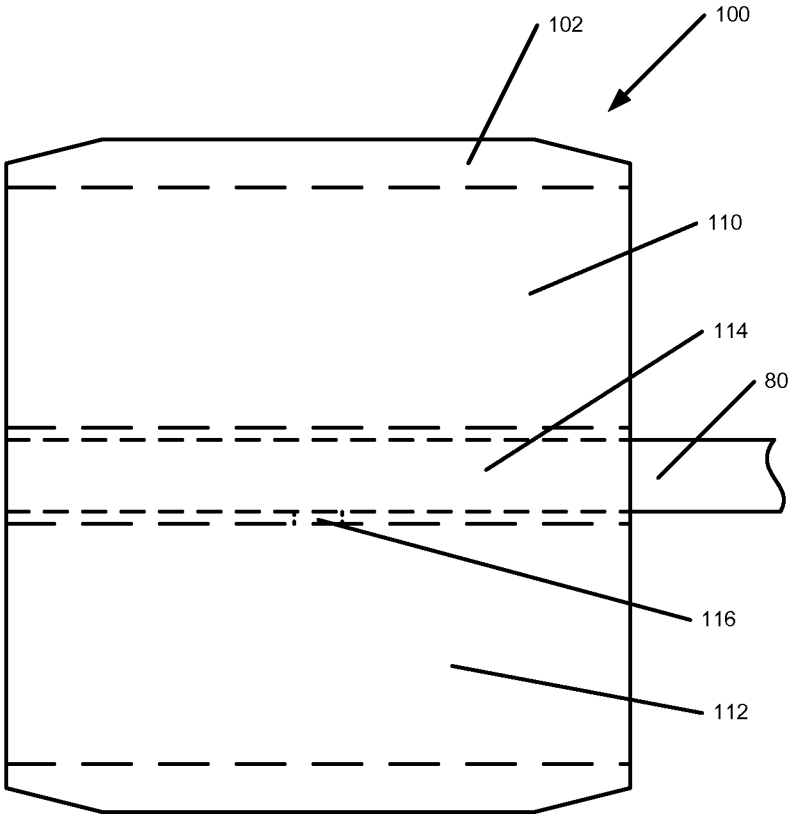
FIG. 4 depicts a side view of the crossover module in FIG. 3.
Figure 3:
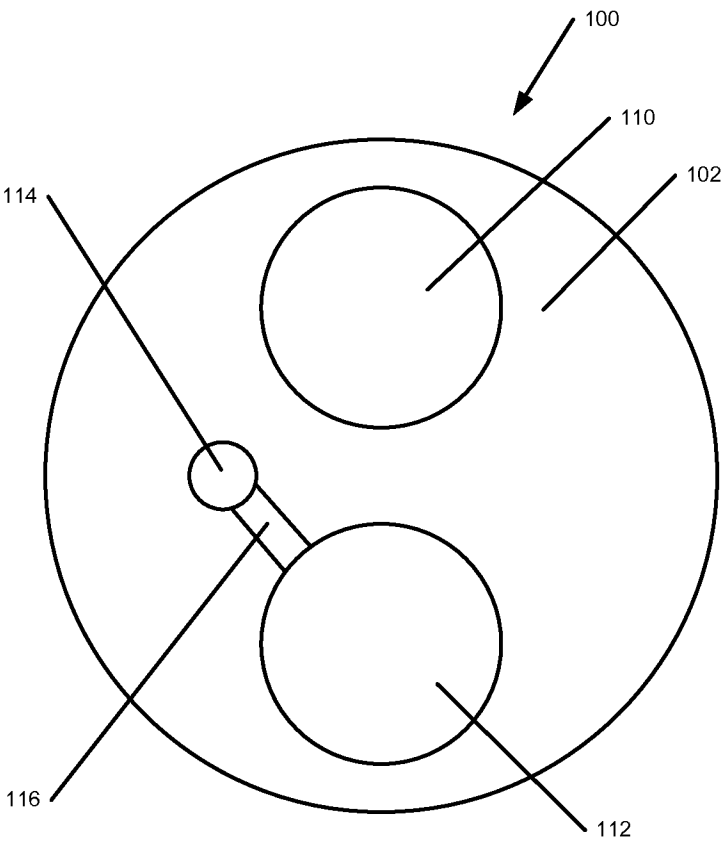
FIG. 3 depicts an end view of a crossover module.

FIG. 3 depicts a crossover module 100 from an end view while FIG. 4 depicts the same crossover module 100 from a side view. The crossover module typically consists of a mandrel 102 having multiple tubular bores shown here as tubular bore 110, tubular bore 112, and bore 114. Bore 114 may or may not pass completely through the crossover module 100. In those instances where bore 114 does pass through the crossover module 100 there is typically some type of blocking device to seal the lower end of bore 114. The crossover module also has a port 116 to fluidly connect a tubular bore, here tubular bore 112, to the bore 114. In FIG. 4 bore 114 is shown as it connects to the internal setting chamber 80.

In FIG. 4 the internal setting chamber 80 is typically a bore in packer housing 31 that utilizes the pressure provided via port 116 from tubular bore 112 to act as the cylinder forcing a piston to provide the mechanical power to set the slips 32 and 34 and if necessary the seal 36.

Figure 5:
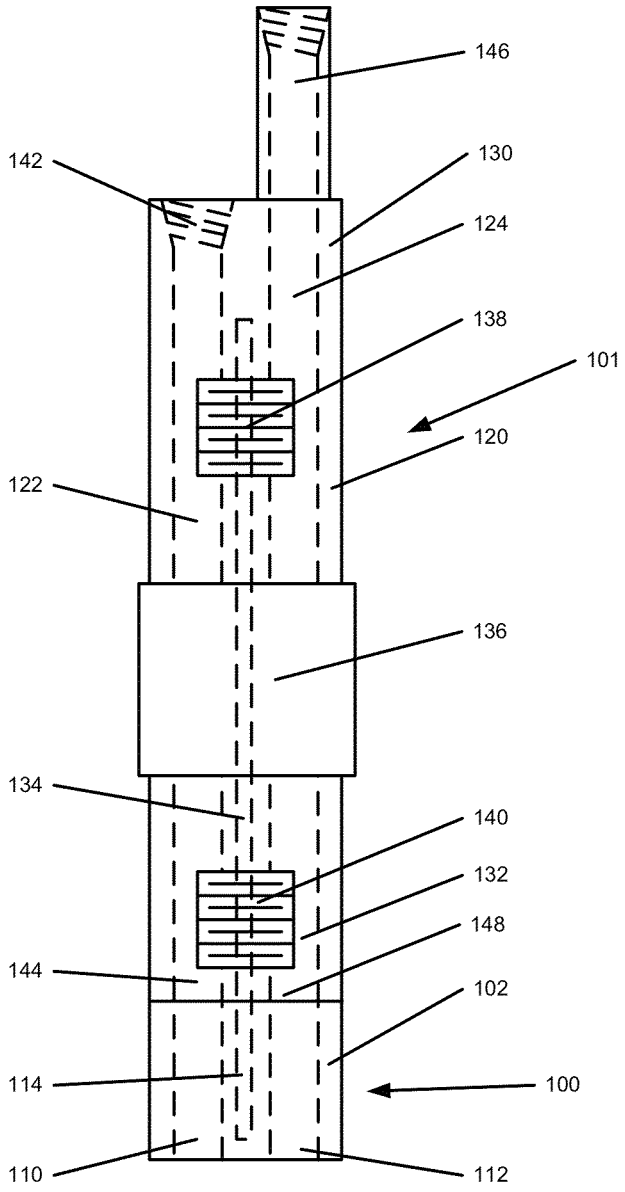
FIG. 5 depicts a dual string packer with a crossover module located near its lower end.

FIG. 5 depicts a typical dual string packer 101 with a crossover module 100 attached at the lower end of the dual string packer 101. For ease of reference the top of FIG. 5 is designated as up or towards the surface 20 (FIG. 1). The dual string packer 101 has a packer housing 120, having at least two longitudinal flow passages shown as tubular bore 122 and tubular bore 124 and an internal setting chamber 134. The dual string packer 101 has an upper end 130, a lower end 132, a resilient elastomeric seal 136, an upper slip 138, a lower slip 140, an upper end 142 of tubular bore 122, a lower end 144 of tubular bore 122, an upper end 146 of tubular bore 124, and a lower end 148 of tubular bore 124.

Attached to the lower end 132 of the dual string packer is the crossover module 110. All references to the crossover module remain as noted in FIGS. 3 and 4. The crossover module 100 has a tubular bore that aligns with each tubular bore of the dual string packer 101. In the particular embodiment shown in FIG. 5 the crossover module 100 has a tubular bore 112 that corresponds to and aligns with the lower end 148 of tubular bore 124. Tubular bore 110 corresponds to and aligns with the lower end 148 of tubular bore 122. Bore 114 corresponds to and aligns with the lower end 148 of internal setting chamber 134. Bore 114 is in fluid communication with a tubular bore, here it is shown to be in fluid communication with tubular bore 112. Fluid communication between the tubular bore 112 and the internal setting chamber 134 may be easily changed by axially rotating the crossover module 100 such that the tubular bore 112 then aligns with the lower end of tubular bore 122 and tubular bore 110 aligns with tubular bore 124, thus providing fluid communication to the surface through tubular bore 122 instead of through tubular bore 124.

By allowing easy removal of the lower end of the dual string packer 101 and access to the crossover module 100 the complete disassembly of the dual string packer on the rig floor and the associated loss of rig time and reliability of the dual string packer is avoided.

Figure 6:
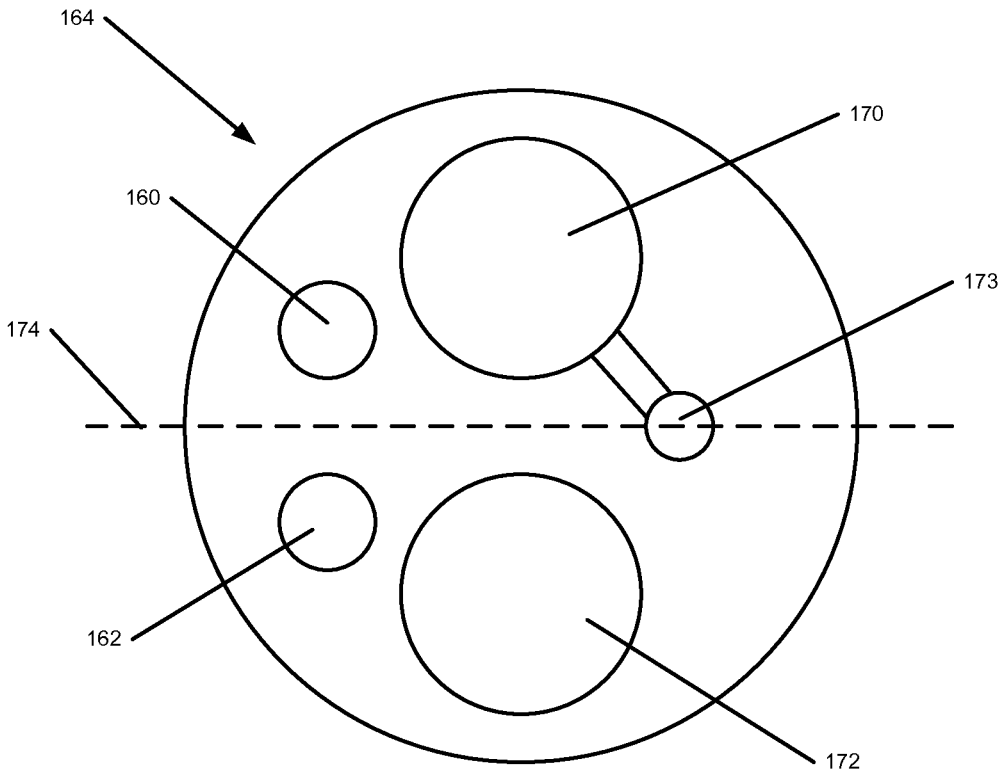
FIG. 6 depicts a crossover module with varying sizes of tubular bores that rotates about a mirror line.

As depicted in FIG. 6, in some instances the dual string packer will have varying numbers of tubular bores and each bore may have a different size. The crossover module 164 may have a corresponding number of tubular bores such as tubular bores 160 and 162 that may vary in size from other tubular bores such as tubular bores 170 and 172. In this particular case the tubular bores are symmetric about a mirror line 174.

In those instances when the tubular bores are symmetric about a mirror line it may be possible to change the fluid access from a bore on one side of the mandrel to a bore on the other side of the mandrel by flipping the crossover module 164 about its mirror line 174. For example tubular bores 160 and 162 (as well as tubular bores 170 and 172) are symmetric to one another with respect to mirror line 174. Having the tubular bores symmetric about the mirror line 174 allows the operator to flip the crossover module over (with respect to the mirror line 174) and each tubular bore would continue to line up with a bore in the main body of the mandrel. However, because the pressure chamber access is to tubular bore 170 (the upper bore in FIG. 6) in the crossover module, when the crossover module is flipped about the mirror line 174 the pressure chamber access is to the lower bore in FIG. 6.

Various sizes of tubular bores may be necessary depending upon conditions further down the wellbore. It may be necessary to pass small hydraulic control lines, capillary tubes, electric lines, fiber optic, cables, or other lines and control devices through the dual string packer and the crossover module. Any combination may be possible depending upon available wellbore cross-section and symmetry of any of the tubular bores that are to remain open.

Figure 7:
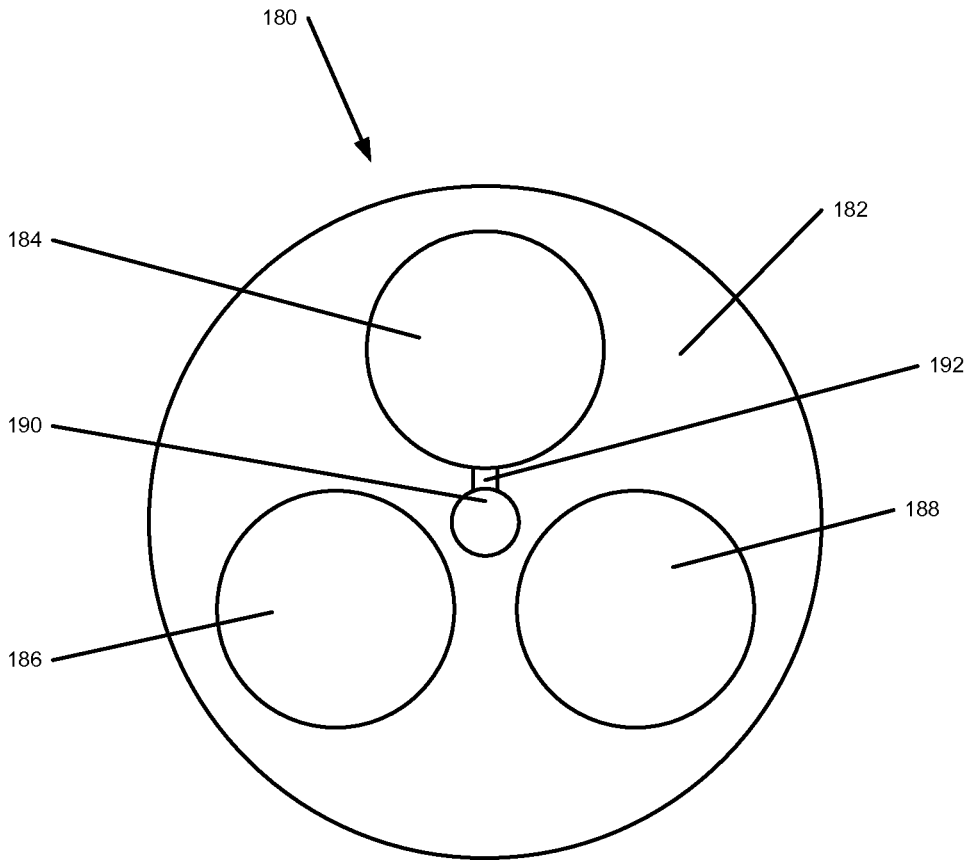
FIG. 7 depicts a crossover module with multiple tubular bores that is indexed about its longitudinal axis.

As depicted in FIG. 7, in some cases the dual string packer will have an odd number of tubular bores requiring the crossover module to have a corresponding odd number of tubular bores. In these cases either flipping the crossover module or rotating the crossover module about its longitudinal axis may be used to change the connection between a particular tubular bore and the pressure chamber.

As shown, a crossover module 180 has 3 tubular bores 186, 188, and 184 in addition to the bore 190 to allow access to the internal setting chamber. Port 192 provides for fluid communication between tubular bore 184 and bore 190. This configuration of the crossover module allows the desired tubular bore in the dual string packer to be used to set the slips and seals in the dual string packer by loosening the crossover module 180 and rotating it about its longitudinal axis to index the tubular bore 184 that is ported via port 192 to the internal setting chamber 190 with the desired tubular bore of the dual string packer.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In particular references to a dual string packer include multiple string packers. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A crossover module for use with a multistring packer, the multistring packer including a housing having at least two longitudinal flow passages disposed therein, at least one sealing element disposed about the housing and actuated by fluid within one of the at least two longitudinal flow passages, and at least one slip assembly supported on the housing and actuated by fluid within one of the at least two longitudinal flow passages, the crossover module comprising:

a mandrel having at least two tubular bores disposed therein, wherein each of the at least two tubular bores corresponds to and aligns with one of the at least two longitudinal flow passages of the multistring packer;

a port configured to hydraulically couple one of the at least two tubular bores to one or more of:

a setting mechanism for the at least one sealing element, and a setting mechanism for the at least one slip assembly;

wherein the at least two tubular bores and the port are arranged such that an orientation of the crossover module may be changed to determine which of the at least two longitudinal flow passages is operable to actuate the at least one sealing element and the at least one slip assembly.

2. The crossover module of claim 1 wherein one of the at least two tubular bores does not pass completely through the crossover module.

3. The crossover module of claim 1 wherein one of the at least two tubular bores has disposed therein a blocking device to seal the lower end of said bore.

4. The crossover module of claim 1 wherein the arrangement of the at least two tubular bores and the port is such that rotation of the crossover module about its longitudinal axis determines which of the at least two longitudinal flow passages is operable to actuate the at least one sealing element and the at least one slip assembly.

5. The crossover module of claim 1 wherein the arrangement of the at least two tubular bores and the port is such that rotation of the crossover module about an axis orthogonal to its longitudinal axis determines which of the at least two longitudinal flow passages is operable to actuate the at least one sealing element and the at least one slip assembly.

6. The crossover module of claim 1 further comprising one or more additional bores through the mandrel for passing one or more hydraulic control lines, capillary tubes, electric lines, or fiber optic cables.

7. A multistring packer comprising:

a housing having at least two longitudinal flow passages disposed therein;

at least one sealing element disposed about the housing and actuated by fluid within one of the at least two longitudinal flow passages;

at least one slip assembly supported on the housing and actuated by fluid within one of the at least two longitudinal flow passages; and a crossover module, the crossover module further comprising:

a mandrel having at least two tubular bores disposed therein, wherein each of the at least two tubular bores corresponds to and aligns with one of the at least two longitudinal flow passages of the multistring packer; and a port configured to hydraulically couple one of the at least two tubular bores to one or more of a setting mechanism for the at least one sealing element and a setting mechanism for the at least one slip assembly;

wherein the at least two tubular bores and the port are arranged such that an orientation of the crossover module may be changed to determine which of the at least two longitudinal flow passages is operable to actuate the at least one sealing element and the at least one slip assembly.

8. The multistring packer of claim 7 wherein one of the at least two tubular bores does not pass completely through the crossover module.

9. The multistring packer of claim 7 wherein one of the at least two tubular bores has disposed therein a blocking device to seal the lower end of said bore.

10. The multistring packer of claim 7, wherein rotation of the crossover module about its longitudinal axis determines which of the at least two longitudinal flow passages is operable to actuate the at least one sealing element and the at least one slip assembly.

11. The multistring packer of claim 7 wherein the arrangement of the at least two tubular bores and the port is such that rotation of the crossover module about an axis orthogonal to its longitudinal axis determines which of the at least two longitudinal flow passages is operable to actuate the at least one sealing element and the at least one slip assembly.

12. The multistring packer of claim 7 further comprising one or more additional bores through the mandrel for passing one or more hydraulic control lines, capillary tubes, electric lines, or fiber optic cables.

13. A method for configuring a multistring packer, the multistring packer including a housing having at least two longitudinal flow passages disposed therein, at least one sealing element disposed about the housing and actuated by fluid within one of the at least two longitudinal flow passages, at least one slip assembly supported on the housing and actuated by fluid within one of the at least two longitudinal flow passages, and a crossover assembly, the crossover assembly further including a mandrel having at least two tubular bores disposed therein, wherein each of the at least two tubular bores corresponds to and aligns with one of the at least two longitudinal flow passages of the multistring packer, and a port configured to hydraulically couple one of the at least two tubular bores to one or more of a setting mechanism for the at least one sealing element and a setting mechanism for the at least one slip assembly, the method comprising:

rotating the crossover assembly to select which of the at least two longitudinal flow passages is operable to actuate the at least one sealing element and the at least one slip assembly.

14. The method of claim 13 wherein rotating the crossover assembly to select which of the at least two longitudinal flow passages is operable to actuate the at least one sealing element and the at least one slip assembly comprises rotating the crossover module about its longitudinal axis.

15. The method of claim 13 wherein rotating the crossover assembly to select which of the at least two longitudinal flow passages is operable to actuate the at least one sealing element and the at least one slip assembly comprises rotating the crossover module about an axis orthogonal to its longitudinal axis.

* * * * *